US009740118B2

(12) United States Patent
Hasegawa et al.

(10) Patent No.: US 9,740,118 B2
(45) Date of Patent: Aug. 22, 2017

(54) METHOD OF PRODUCING LIQUID DEVELOPER

(71) Applicant: CANON KABUSHIKI KAISHA, Tokyo (JP)

(72) Inventors: Waka Hasegawa, Tokyo (JP); Ryo Natori, Tokyo (JP); Ayano Mashida, Kawasaki (JP); Junji Ito, Hiratsuka (JP); Yasuhiro Aichi, Tokyo (JP); Jun Shirakawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/166,650

(22) Filed: May 27, 2016

(65) Prior Publication Data

US 2016/0349637 A1 Dec. 1, 2016

(30) Foreign Application Priority Data

May 27, 2015 (JP) ..... 2015-107350
Mar. 7, 2016 (JP) ..... 2016-043105

(51) Int. Cl.

| | |
|---|---|
| ***G03G 9/13*** | (2006.01) |
| ***G03G 9/08*** | (2006.01) |
| ***G03G 9/125*** | (2006.01) |
| ***G03G 9/087*** | (2006.01) |
| *G03G 15/10* | (2006.01) |

(52) U.S. Cl.

CPC ..... *G03G 9/0806* (2013.01); *G03G 9/0804* (2013.01); *G03G 9/08755* (2013.01); *G03G 9/08764* (2013.01); *G03G 9/125* (2013.01); *G03G 9/13* (2013.01); *G03G 9/131* (2013.01); *G03G 9/132* (2013.01); *G03G 9/133* (2013.01); *G03G 15/10* (2013.01)

(58) Field of Classification Search

CPC ..... G03G 9/132; G03G 9/133; G03G 9/131; G03G 9/13; G03G 9/125
USPC ..... 430/137.22, 114, 115, 112
See application file for complete search history.

(56) References Cited

U.S. PATENT DOCUMENTS

| | | | | |
|---|---|---|---|---|
| 3,849,165 | A * | 11/1974 | Stahly | G03G 9/131 430/112 |
| 5,395,724 | A | 3/1995 | Morrison et al. | |
| 6,203,961 | B1 | 3/2001 | Pan et al. | |
| 7,833,687 | B2 | 11/2010 | Kato et al. | |
| 7,851,117 | B2 | 12/2010 | Yodo et al. | |
| 8,399,170 | B2 * | 3/2013 | Iwase | G03G 9/12 430/116 |
| 8,697,327 | B2 | 4/2014 | Shibata et al. | |
| 8,815,484 | B2 | 8/2014 | Tanaka et al. | |
| 9,057,970 | B2 | 6/2015 | Ida et al. | |
| 9,229,345 | B2 | 1/2016 | Ikeda et al. | |
| 9,348,247 | B2 | 5/2016 | Ida et al. | |
| 2007/0031751 | A1 | 2/2007 | Teishev et al. | |
| 2010/0055602 | A1 | 3/2010 | Teshima | |
| 2014/0234769 | A1 | 8/2014 | Yoshie et al. | |
| 2014/0356779 | A1 | 12/2014 | Hasegawa et al. | |
| 2014/0377697 | A1 | 12/2014 | Nishiura et al. | |
| 2015/0004539 | A1 | 1/2015 | Watanabe et al. | |
| 2015/0192875 | A1 | 7/2015 | Ito et al. | |
| 2015/0274853 | A1 | 10/2015 | Nishiura et al. | |
| 2015/0277254 | A1 | 10/2015 | Mukumoto et al. | |

FOREIGN PATENT DOCUMENTS

| | | |
|---|---|---|
| EP | 0 586 051 | 3/1994 |
| EP | 1 898 267 | 3/2008 |
| EP | 2955579 | 12/2015 |
| JP | 4977034 B2 | 7/2012 |

OTHER PUBLICATIONS

U.S. Appl. No. 15/166,614, filed May 27, 2016.
U.S. Appl. No. 15/166,633, filed May 27, 2016.
U.S. Appl. No. 15/166,643, filed May 27, 2016.
U.S. Appl. No. 15/166,685, filed May 27, 2016.
U.S. Appl. No. 15/166,709, filed May 27, 2016.
Herbst, et al., Industrial Organic Pigments, 3d ed., Wiley-VCH Verlag GmbhH & Co. KGaA, Weiheim, ISBN 3-527-30576 (2004) 637-45.
Harazaki, Coating Basics and Engineering, Coating Technical Institute, Publisher: Converting Technical Institute, ISBN-10:4906451381, ISBN-13:978-4906451388 (Sogo Gyutsu Center, JP) pub (2010) 53.
Herbst, et al., Industrial Organic Pigments, 3rd ed., WILEY-VCH Verlag GmbH & Co. KGaA, Weinheim, ISBN: 3-527-30576-9 (2004) 637-45.
Harazaki, Coating Basics and Engineering, Publisher: Converting Technical Institute, ISBN-10: 4906451381, ISBN-13: 978-4906451388, pub (2010) 53.

* cited by examiner

*Primary Examiner* — Janis L Dote
(74) *Attorney, Agent, or Firm* — Fitzpatrick Cella Harper and Scinto

(57) ABSTRACT

Provided is a method of producing a liquid developer containing a dispersing agent, an insulating liquid (a), and a toner particle that contains a colorant and a binder resin, the method including a step (1) of preparing a mixture containing the colorant, the binder resin, the insulating liquid (a), a solvent (b), and the dispersing agent, and a step (2) of distillatively removing the solvent (b) from the mixture, wherein the binder resin dissolves in the solvent (b) and does not dissolve in the insulating liquid (a), the dispersing agent dissolves in both the insulating liquid (a) and the solvent (b), and the binder resin contains a polymer A that has an alkali metal sulfonate group or an alkaline-earth metal sulfonate group.

7 Claims, 1 Drawing Sheet

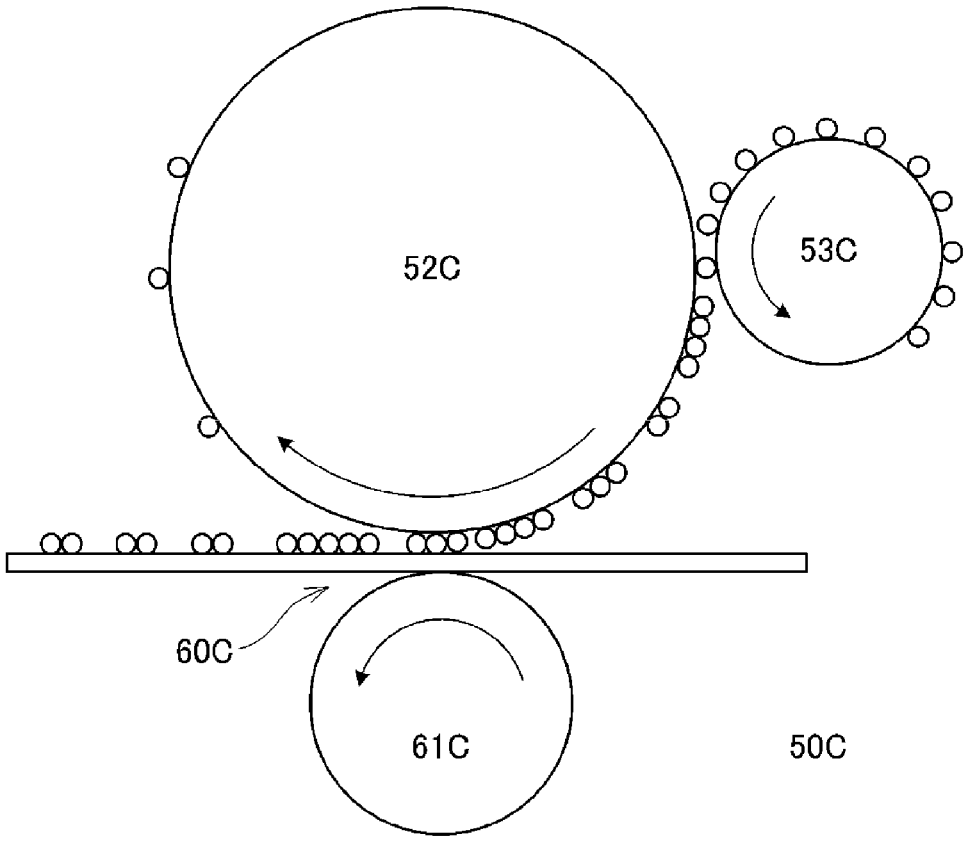
52C
53C
60C
61C
50C

METHOD OF PRODUCING LIQUID DEVELOPER

BACKGROUND OF THE INVENTION

Field of the Invention

The present invention relates to a method of producing a liquid developer for use in an image-forming apparatus that utilizes an electrophotographic system, e.g., electrophotography, electrostatic recording, electrostatic printing, and so forth.

Description of the Related Art

Plate-based presses have in the past been used to produce printed material for which a certain number of copies are required, such as regional advertising, internally distributed business documents, and large posters. In place of these conventional presses, on-demand presses have entered into use in recent years; these on-demand presses can rapidly respond to a diversifying range of needs and support inventory reductions. Electrophotographic printers that use a dry developer or a liquid developer and inkjet printers capable of high speeds and high quality printing are anticipated for such on-demand printers.

Dry developers currently occupy the developer mainstream due to their handling advantages, which derive from the fact that a solid developer is being handled. However, viewed from the standpoint of preventing the image deterioration caused by changes in the environment, e.g., temperature and humidity, the environmental stability of the charging performance has been a problem with dry developers. In addition, the colored resin particles in a dry developer readily undergo aggregation during, for example, storage, and uniformity when the colored resin particles are dispersed has been a problem. In addition, with regard to their properties, when the colored resin particle diameter is made relatively small in pursuit of high resolution, the problems deriving from the fact that the dry developer is in the form of powder is involved as described above become even more substantial.

Liquid developers, on the other hand, use an electrically insulating liquid as a carrier liquid and because of this are more resistant than dry developers to the problem of aggregation of the colored resin particles in the liquid developer during storage, and a microfine toner can thus be used. As a result, liquid developers provide a better fine line image reproducibility and a better gradation reproducibility than dry developers and are characterized by an excellent color reproducibility and also excellence in high-speed image-forming methods. Development is becoming quite active with regard to high-image-quality, high-speed digital printing apparatuses that exploit these excellent features by utilizing electrophotographic technologies that use liquid developers. In view of these circumstances, there is demand for the development of liquid developers that have even better properties.

Japanese Patent No. 4,977,034 discloses a liquid developer that is produced using the coacervation method and that has colored resin particles containing an acid group-bearing resin having an acid value of 1 to 100 dispersed in an insulating hydrocarbon-type dispersion medium.

SUMMARY OF THE INVENTION

A small toner particle diameter and a sharp particle size distribution are required in order to obtain a high image quality with a thin film. However, the particle diameter of the toner in the liquid developer disclosed in Japanese Patent No. 4,977,034 is 3 micrometer at its largest and the particle size distribution is also from 1 micrometer to 3 micrometer, and as a consequence this is unsatisfactory for providing a high image quality with a thin film.

The present invention provides a method of producing a liquid developer that has a small particle diameter for the toner particles in the liquid developer, that has a narrow toner particle size distribution, and that exhibits an excellent developing performance.

The present invention is a method of producing a liquid developer containing a dispersing agent, an insulating liquid (a), and a toner particle that contains a colorant and a binder resin, the method including a step (1) of preparing a mixture containing the colorant, the binder resin, the insulating liquid (a), a solvent (b), and the dispersing agent; and a step (2) of distillatively removing the solvent (b) from the mixture, wherein the binder resin dissolves in the solvent (b) and does not dissolve in the insulating liquid (a), the dispersing agent dissolves in both the insulating liquid (a) and the solvent (b), and the binder resin contains a polymer A that has an alkali metal sulfonate group or an alkaline-earth metal sulfonate group.

The present invention can provide a method of producing a liquid developer that has a small particle diameter for the toner particles in the liquid developer, that has a narrow toner particle size distribution, and that exhibits an excellent developing performance.

Further features of the present invention will become apparent from the following description of exemplary embodiments (with reference to the attached drawings).

BRIEF DESCRIPTION OF THE DRAWINGS

FIG. 1 is a schematic diagram of a developing assembly.

DESCRIPTION OF THE EMBODIMENTS

The present invention is a method of producing a liquid developer containing a dispersing agent, an insulating liquid (a), and a toner particle that contains a colorant and a binder resin, the method including a step (1) of preparing a mixture containing the colorant, the binder resin, the insulating liquid (a), a solvent (b), and the dispersing agent; and a step (2) of distillatively removing the solvent (b) from the mixture, wherein the binder resin dissolves in the solvent (b) and does not dissolve in the insulating liquid (a), the dispersing agent dissolves in both the insulating liquid (a) and the solvent (b), and the binder resin contains a polymer A that has an alkali metal sulfonate group or an alkaline-earth metal sulfonate group.

Unless specifically indicated otherwise, the phrases "at least XX and not more than YY" and "XX to YY" used to represent numerical value ranges in the present invention denote numerical value ranges that include the lower limit and upper limit that are the end points.

Each of the components is described in detail in the following.

<The Binder Resin>

The toner particle in the present invention contains a binder resin. Known binder resins that have a fixing performance for adherends such as paper and plastic film can be used as this binder resin.

This binder resin dissolves in the solvent (b) and does not dissolve in the insulating liquid (a), but is not otherwise particularly limited.

Examples are resins such as epoxy resins; polyester-type resins such as alkyd resins and polyester resins; vinyl resins such as polyethylene resins, (meth)acrylic resins, ethylene-(meth)acrylic resins, and styrene-(meth)acrylic resins; rosin-modified resins; polyurethane resins; polyamide resins; polyimide resins; silicon resins; and phenolic resins. Two or more of these resins may be used in combination.

The use of at least one selection from the group consisting of vinyl resins, polyester resins, polyurethane resins, and epoxy resins for the binder resin is preferred in the present invention, while the use of at least one selection from the group consisting of polyester resins and vinyl resins is more preferred.

The binder resin preferably contains polyester resin and the polyester resin content in the binder resin is preferably at least 50 mass %, more preferably at least 60 mass %, and even more preferably at least 80 mass %.

This polyester resin is preferably a condensation polymer from a diol and a dicarboxylic acid.

The diol can be exemplified by ethylene glycol, propylene glycol, neopentyl glycol, and ethylene oxide adducts and/or propylene oxide adducts on bisphenol A.

The dicarboxylic acid can be exemplified by terephthalic acid, isophthalic acid, ortho-phthalic acid, and fumaric acid.

The monomer used for the vinyl resin can be exemplified by styrene, (meth)acrylic acid, methyl(meth)acrylate, and butyl(meth)acrylate.

<The Polymer A>

The binder resin in the present invention contains a polymer A that has an alkali metal sulfonate group or an alkaline-earth metal sulfonate group. The binder resin may contain a polymer A that has an alkali metal sulfonate group and an alkaline-earth metal sulfonate group.

The metal atom M in the alkali metal sulfonate group or alkaline-earth metal sulfonate group (—$SO_3M$ group) is, for example, lithium, sodium, magnesium, calcium, or barium.

A known method—e.g., a method that uses a compound having an alkali metal sulfonate group or an alkaline-earth metal sulfonate group for a portion of the starting material, or a method in which the polymer is synthesized using a sulfonic acid group-bearing compound followed by neutralization with an alkali metal or alkaline-earth metal hydroxide—can be used as the method for introducing the alkali metal sulfonate group or alkaline-earth metal sulfonate group into the polymer.

The polymer A is not particularly limited as to type and can be exemplified by resins such as epoxy resins; polyester-type resins such as alkyd resins and polyester resins; vinyl resins such as polyethylene resins, (meth)acrylic resins, ethylene-(meth)acrylic resins, and styrene-(meth)acrylic resins; rosin-modified resins; polyurethane resins; polyamide resins; polyimide resins; silicon resins; and phenolic resins. Two or more of these resins may be used in combination.

When polymer A is a vinyl resin, the monomer used can be exemplified by styrene, (meth)acrylic acid, methyl(meth) acrylate, and butyl(meth)acrylate.

A known vinyl compound, for example, sodium vinylsulfonate, sodium allylsulfonate, sodium 2-methyl-2-propene-1-sulfonate, sodium 4-vinylbenzenesulfonate, and so forth, may be used for a portion of the starting material as a method for introducing the alkali metal sulfonate group or alkaline-earth metal sulfonate group into the vinyl polymer.

When the polymer A is a polyester resin, this polyester resin is preferably a condensation polymer from a diol and a dicarboxylic acid.

The diol can be exemplified by ethylene glycol, propylene glycol, neopentyl glycol, and ethylene oxide and/or propylene oxide adducts on bisphenol A.

The dicarboxylic acid can be exemplified by terephthalic acid, isophthalic acid, ortho-phthalic acid, and fumaric acid.

The method for introducing the alkali metal sulfonate group or alkaline-earth metal sulfonate group into the polyester resin may be a known procedure but is not otherwise particularly limited; it can be exemplified by a method that uses, e.g., sodium 5-sulfoisophthalate or a derivative thereof, for a portion of the dicarboxylic acid starting material.

The content of the monomer unit derived from an alkali metal sulfonate group or an alkaline-earth metal sulfonate group-bearing compound in the total monomer unit constituting the polymer A is preferably at least 0.2 mass % and not more than 15.0 mass % and is more preferably at least 1.0 mass % and not more than 8.0 mass %. Here, "monomer unit" denotes the reacted state for the monomer substance in the polymer.

The polymer A preferably contains a polyester structure in the present invention. The reason for this is that the difference between the solubility in the insulating liquid (a) and the solubility in the solvent (b) is large for polyester structures.

The polymer A is more preferably a polymer obtained by the reaction of a diisocyanate compound and an alkali metal sulfonate group or an alkaline-earth metal sulfonate group-bearing polyester polyol.

The reason for this is that polymers obtained by the reaction of a diisocyanate compound and an alkali metal sulfonate group or an alkaline-earth metal sulfonate group-bearing polyester polyol, exhibit even larger differences between the solubility in the insulating liquid (a) and the solubility in the solvent (b).

The number-average molecular weight (Mn) of the polymer A is preferably at least 10,000 and not more than 30,000, more preferably at least 10,000 and not more than 25,000, and even more preferably at least 10,000 and not more than 20,000. Having the weight-average molecular weight of the polymer A satisfy the indicated range provides a smaller toner particle diameter, a narrower toner particle size distribution, and an even better developing performance.

The toner particle size distribution assumes a broadening trend when the number-average molecular weight of the polymer A is less than 10,000.

While the reason for this is unclear, it is thought that the compatibility with the binder resin increases when the number-average molecular weight of the polymer A is less than 10,000 and that the segregation of the polymer A to the vicinity of the surface layer of the binder resin is then impeded. When, on the other hand, the number-average molecular weight of the polymer A exceeds 30,000, the solubility of the polymer A in the solvent (b) then assumes a declining trend.

The content of the polymer A in the binder resin is preferably at least 1 mass % and not more than 80 mass % and is more preferably at least 3 mass % and not more than 30 mass %.

Defining the phase separation point A as the mixing mass ratio for the insulating liquid (a) and the solvent (b) at which separation into two phases occurs when the insulating liquid (a) is added to a solution obtained by dissolving the polymer A in the solvent (b), and defining the phase separation point B as the mixing mass ratio for the insulating liquid (a) and the solvent (b) at which separation into two phases occurs when the insulating liquid (a) is added to a solution obtained by the dissolution in the solvent (b) of the resin component in the binder resin other than the polymer A, then in the present invention the phase separation point A is preferably larger than the phase separation point B (i.e., phase separation point A>phase separation point B is satisfied).

In addition, phase separation point A≥(phase separation point B+0.10) is more preferred.

When this relationship is satisfied, the polymer A readily segregates in the toner particle to the vicinity of the surface layer of the binder resin and the functions of the present invention can be exhibited at smaller amounts of the polymer A.

The number-average molecular weight of the resin component in the binder resin other than the polymer A is preferably at least 1,000 and not more than 30,000 and more preferably at least 2,000 and not more than 20,000.

When the number-average molecular weight is less than 1,000, the component soluble in the insulating liquid (a) assumes an increasing trend. When, on the other hand, the number-average molecular weight exceeds 30,000, the solubility in the solvent (b) assumes a declining trend.

The binder resin content is not particularly limited, but, expressed per 100 mass parts of the colorant, is preferably at least 10 mass parts and not more than 2,000 mass parts and is more preferably at least 20 mass parts and not more than 200 mass parts.

The concentration of the binder resin with reference to the total amount of the insulating liquid (a) and the solvent (b) is preferably at least 0.5 mass % and not more than 70 mass %.

<The Colorant>

The toner particle in the present invention contains a colorant. There are no particular limitations on the colorant, and, for example, any generally commercially available organic pigment, organic dye, inorganic pigment, pigment dispersed in, e.g., an insoluble resin as a dispersion medium, or pigment having a resin grafted to its surface can be used.

These pigments can be exemplified by the pigments described in "Industrial Organic Pigments", W. Herbst and K. Hunger.

The following are specific examples of pigments that present a yellow color:

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Pigments that present a red or magenta color can be exemplified by the following:

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C. I. Pigment Violet 19; and C. I. Vat Red 1, 2, 10, 13, 15, 23, 29, and 35.

Pigments that present a blue or cyan color can be exemplified by the following:

C. I. Pigment Blue 2, 3, 15:2, 15:3, 15:4, 16, and 17; C. I. Vat Blue 6; C. I. Acid Blue 45; and copper phthalocyanine pigments in which the phthalocyanine skeleton is substituted by 1 to 5 phthalimidomethyl groups.

Pigments that present a green color can be exemplified by the following:

C. I. Pigment Green 7, 8, and 36.

Pigments that present an orange color can be exemplified by the following:

C. I. Pigment Orange 66 and 51.

Pigments that present a black color can be exemplified by the following:

carbon black, titanium black, and aniline black.

Pigments that present a white color can be exemplified by the following:

basic lead carbonate, zinc oxide, titanium oxide, and strontium titanate.

A dispersing means adapted to the toner particle production method may be used to disperse the pigment in the toner particle. Devices that can be used as this dispersing means are, for example, a ball mill, sand mill, attritor, roll mill, jet mill, homogenizer, paint shaker, kneader, agitator, Henschel mixer, colloid mill, ultrasonic homogenizer, pearl mill, wet jet mill, and so forth.

A pigment dispersing agent may also be added when pigment dispersion is carried out. The pigment dispersing agent can be exemplified by hydroxyl group-bearing carboxylate esters, the salts of long-chain polyaminoamides and high molecular weight acid esters, the salts of high molecular weight polycarboxylic acids, high molecular weight unsaturated acid esters, high molecular weight copolymers, modified polyacrylates, aliphatic polybasic carboxylic acids, naphthalenesulfonic acid/formalin condensates, polyoxyethylene alkyl phosphate esters, and pigment derivatives. A commercial polymeric dispersing agent, e.g., the Solsperse series (Lubrizol Japan Ltd.), is also preferably used.

A synergist adapted to the particular pigment may also be used as a pigment dispersing aid.

The amount of addition of these pigment dispersing agents and pigment dispersing aids is preferably at least 1 mass parts and not more than 50 mass parts per 100 mass parts of the pigment.

<The Insulating Liquid (a)>

The liquid developer contains an insulating liquid (a) in the present invention.

The insulating liquid exhibits an electrical insulating behavior and preferably has a volume resistivity of at least $1\times10^{9}$ Ω·cm and not more than $1\times10^{13}$ Ω·cm.

The binder resin does not dissolve in the insulating liquid (a) in the present invention.

The "binder resin does not dissolve in the insulating liquid (a)" is provided as an indicator that not more than 1 mass parts of the binder resin dissolves at a temperature of 25° C. in 100 mass parts of the insulating liquid (a).

The insulating liquid (a) in the present invention preferably has an SP value of at least 7.0 and not more than 9.0 and more preferably has an SP value of at least 7.5 and not more than 8.5. A resin that does not dissolve in an insulating liquid (a) that has an SP value of at least 7.0 and not more than 9.0 is desirably used for the binder resin.

The SP value is the solubility parameter. The SP value is a value introduced by Hildebrand and defined by a formal theory. It is given by the square root of the cohesive energy density of the solvent (or solute) and is a measure of the solubility in a two-component system solution. In the present invention, the SP value is the value determined by calculation from the vaporization energy and molar volume of the atoms and atomic groups in accordance with Fedors as described in Coating Basics and Engineering (page 53, Yuji Harasaki, Converting Technical Institute). The unit for the SP value in the present invention is $(cal/cm^3)^{1/2}$, but this can be converted to the $(J/m^3)^{1/2}$ unit using 1 $(cal/cm^3)^{1/2}=2.046\times10^3\ (J/m^3)^{1/2}$.

The insulating liquid (a) can be exemplified by hydrocarbon solvents such as octane, isooctane, decane, isodecane, decalin, nonane, dodecane, and isododecane, and by paraffin solvents such as ISOPAR E, ISOPAR G, ISOPAR H, ISOPAR L, ISOPAR M, and ISOPAR V (Exxon Mobil Corporation), SHELLSOL A100 and SHELLSOL A150 (Shell Chemicals Japan Ltd.), and Moresco WHITE MT-30P (Matsumura Oil Co., Ltd.).

A vinyl ether compound can also be used for the insulating liquid (a). This vinyl ether compound refers to a compound that has a vinyl ether structure (—CH=CH—O—C—).

Specific examples are dodecyl vinyl ether, dicyclopentadiene vinyl ether, cyclohexanedimethanol divinyl ether, tricyclodecane vinyl ether, dipropylene glycol divinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, and 1,2-decanediol divinyl ether.

<The Solvent (b)>

The binder resin dissolves in the solvent (b) in the present invention.

Here, the "binder resin dissolves in the solvent (b)" is provided as an indicator that more than 10 mass parts of the binder resin dissolves in 100 mass parts of the solvent (b) at a temperature of 25° C.

The solvent (b) used desirably has an SP value larger than that for the insulating liquid (a). In addition, the SP value of the solvent (b) is preferably at least 8.5 and not more than 15.0 and is more preferably at least 9.0 and not more than 13.0. A resin that dissolves in a solvent (b) that has an SP value of at least 8.5 and not more than 15.0 is desirably used for the binder resin.

Considering the distillative removal from the mixture by distillation, the solvent (b) is preferably a solvent that has a low boiling point. The boiling point of the solvent (b) is preferably not more than 150° C. and is more preferably not more than 100° C.

The solvent (b) can be exemplified by toluene (SP value=8.9, boiling point=110° C.), chloroform (SP value=9.2, boiling point=61° C.), methyl ethyl ketone (SP value=9.3, boiling point=80° C.), tetrahydrofuran (SP value=9.5, boiling point=66° C.), acetone (SP value=9.8, boiling point=56° C.), ethanol (SP value=13, boiling point=78° C.), and methanol (SP value=14, boiling point=65° C.)

<The Dispersing Agent>

The liquid developer contains a dispersing agent in the present invention. This dispersing agent promotes toner particle formation and supports a stable dispersion of the toner particles in the insulating liquid (a).

In addition, the dispersing agent dissolves in both the insulating liquid (a) and the solvent (b).

Here, "the dispersing agent dissolves in both the insulating liquid (a) and the solvent (b)" is provided as an indicator that more than 10 mass parts of the dispersing agent dissolves in 100 mass parts of the insulating liquid (a) at a temperature of 25° C. and that more than 10 mass parts of the dispersing agent dissolves in 100 mass parts of the solvent (b) at a temperature of 25° C.

When the liquid developer is produced using the coacervation method, the dispersion stability of the toner particles in the insulating liquid (a) can be raised by dispersing the toner particles in the insulating liquid (a) in the presence of a dispersing agent. The charging characteristics and migration behavior of the toner particles can also be improved.

This dispersing agent should be able to dissolve in the insulating liquid (a) and the solvent (b) and should be able to bring about a stable toner particle dispersion, but is not otherwise particularly limited as to type and can be selected from known dispersing agents.

Examples of commercial products that can be used as this dispersing agent are AJISPER PB817 (reaction product of polyallylamine and 12-hydroxystearic acid self-condensate, Ajinomoto Fine-Techno Co., Inc.) and SOLSPERSE 13940 (reaction product of polyethylenepolyamine and 12-hydroxystearic acid self-condensate), 11200, 17000, and 18000 (Lubrizol Japan Ltd.).

This dispersing agent is preferably a dispersing agent (c) that is a polymer that contains at least both a monomer unit given by the following general formula (1) and a monomer unit given by the following general formula (2) wherein this dispersing agent has a monomer unit given by general formula (1) at a position other than the terminal position. For example, the aforementioned AJISPER PB817 corresponds to this dispersing agent (c). The aforementioned SOLSPERSE 13940 (other than the amino group in terminal position, the amino groups resulting from the reaction product of polyethylenepolyamine and 12-hydroxystearic acid self-condensate are all secondary amino groups or tertiary amino groups, i.e., the primary amino group is not present at other than the terminal position), on the other hand, does not correspond to a dispersing agent (c).

$$\text{-}(K)\text{-} \qquad \text{formula (1)}$$

[In formula (1), K is a monomer unit that has a primary amino group.]

$$\text{-}(Q)\text{-} \qquad \text{formula (2)}$$

[In formula (2), Q is a monomer unit having an alkyl group having at least 6 carbons, which may also be substituted, a cycloalkyl group having at least 6 carbons, which may also be substituted, an alkylene group having at least 6 carbons, which may also be substituted, or a cycloalkylene group having at least 6 carbons, which may also be substituted.]

The molecular weight of this dispersing agent will depend on the number of monomer units with general formula (1) and monomer units with general formula (2) that constitute the dispersing agent, but the number-average molecular weight is preferably at least 1,000 and not more than 400,000. Having the number-average molecular weight be in the indicated range provides an excellent toner particle dispersion stability.

Using 1 for the number of monomer units with general formula (1) present in the dispersing agent, the number of monomer units with general formula (2) present in the dispersing agent is, on average, preferably at least 0.01 and not more than 100 and more preferably at least 0.1 and not more than 10.

When the number of monomer units with formula (2) is on average at least 0.01, a satisfactory affinity for the insulating liquid (a) is established; when not more than 100, an excellent toner particle dispersion stability is established.

The content of the dispersing agent is preferably at least 0.5 mass parts and not more than 20 mass parts per 100 mass parts of the binder resin.

When this range is used, an excellent toner particle dispersibility is established and the dispersing agent also does not trap the insulating liquid (a) and an excellent toner particle fixing strength can be maintained.

One or two or more of these dispersing agents can be used in the present invention.

The following are preferred for the present invention: the acid value of the binder resin is at least 5 mg KOH/g; the dispersing agent is a polymer that contains at least both a monomer unit given by the aforementioned general formula (1) and a monomer unit given by the aforementioned general formula (2); and the dispersing agent has a monomer unit with general formula (1) at a position other than terminal position.

<Charge Control Agent>

The liquid developer in the present invention may as necessary contain a charge control agent. A known charge control agent can be used as this charge control agent.

The following are examples of specific compounds:

fats and oils such as linseed oil and soy oil; alkyd resins; halogen polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octanoate, nickel octanoate, zinc octanoate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as hydrogenated lecithin and lecithin; metal salicylates such as metal t-butylsalicylate complexes; polyvinylpyrrolidone resins; polyamide resins; sulfonic acid-containing resins; and hydroxybenzoic acid derivatives.

<Charge Adjuvant>

A charge adjuvant can as necessary be incorporated in the toner particle in the present invention with the goal of adjusting the toner particle charging performance. A known charge adjuvant can be used as this charge adjuvant.

Examples of specific compounds are as follows: metal soaps such as zirconium naphthenate, cobalt naphthenate, nickel naphthenate, iron naphthenate, zinc naphthenate, cobalt octanoate, nickel octanoate, zinc octanoate, cobalt dodecanoate, nickel dodecanoate, zinc dodecanoate, aluminum stearate, aluminum tristearate, and cobalt 2-ethylhexanoate; metal sulfonates such as petroleum-based metal sulfonates and metal salts of sulfosuccinate esters; phospholipids such as hydrogenated lecithin and lecithin; metal salicylates such as metal t-butylsalicylate complexes; polyvinylpyrrolidone resins; polyamide resins; sulfonic acid-containing resins; and hydroxybenzoic acid derivatives.

<Other Additives>

In addition to those described above, various known additives may as necessary be used in the liquid developer of the present invention with the goal of improving the compatibility with recording media, the storage stability, the image storability, and other characteristics. Examples here are surfactant, lubricant, filler, antifoaming agent, ultraviolet absorber, antioxidant, anti-fading agent, fungicide, anticorrosion agent, and so forth, and these can be selected as appropriate and used.

<The Method of Producing the Liquid Developer>

The method of the present invention for producing a liquid developer is a method for producing a liquid developer containing a dispersing agent, an insulating liquid (a), and a toner particle that contains a colorant and a binder resin, the method including a step (1) of preparing a mixture containing the colorant, the binder resin, the insulating liquid (a), the solvent (b), and the dispersing agent, and a step (2) of distillatively removing the solvent (b) from the mixture, wherein the binder resin dissolves in the solvent (b) and does not dissolve in the insulating liquid (a), the dispersing agent dissolves in both the insulating liquid (a) and the solvent (b), and the binder resin contains the polymer A that has an alkali metal sulfonate group or an alkaline-earth metal sulfonate group.

In addition, the step (1) in the present invention preferably includes a step of preparing a solution or a dispersion by dissolving or dispersing the colorant, the binder resin, and the dispersing agent in the solvent (b), and a step of mixing the solution or dispersion with the insulating liquid (a) in order to precipitate the binder resin that had been present in a dissolved state in the solution or dispersion.

A specific production method is described in the following, but this does not mean that the present invention is limited to or by this.

<Step (1)>

A solution or dispersion is prepared in step (1) by dissolving or dispersing the colorant, binder resin, and dispersing agent in the solvent (b).

This step of preparing a solution or dispersion may contain the following steps:

a step (a) of mixing the solvent (b), the colorant, the dispersing agent, and the polymer A and dissolving or dispersing the individual materials using a media-based disperser, e.g., an attritor, ball mill, sand mill, and so forth, or a media-free disperser, e.g., a high-speed mixer, a high-speed homogenizer, and so forth, to obtain a first solution or dispersion; and a step (b) of adding the dispersing agent, the solvent (b), and the resin component other than the polymer A, to the first solution or dispersion and dissolving or dispersing the individual materials using a media-based disperser, e.g., an attritor, ball mill, sand mill, and so forth, or a media-free disperser, e.g., a high-speed mixer, a high-speed homogenizer, and so forth, to obtain a second solution or dispersion.

The amount of addition (total amount) of the solvent (b) with reference to the binder resin, expressed per 100 mass parts of the binder resin, is preferably at least 5 mass parts and not more than 150 mass parts and is more preferably at least 10 mass parts and not more than 75 mass parts. An excellent productivity is obtained and the formation of a desirable toner shape is facilitated by having the amount of solvent (b) addition be in the indicated range.

The amount of addition of the binder resin with reference to the colorant, expressed per 100 mass parts of the colorant, is preferably at least 10 mass parts and not more than 2,000 mass parts and is more preferably at least 20 mass parts and not more than 200 mass parts. By having the amount of colorant addition be in the indicated range, a high density image is then readily formed and the formation of a desirable toner particle shape is facilitated.

In this example, the binder resin is composed of the polymer A and the resin component other than the polymer A.

The insulating liquid (a) is then preferably mixed with the second solution or dispersion obtained in the step (b) to obtain a mixture in which the binder resin, which had been present in a dissolved state in the second solution or dispersion, has been precipitated (also referred to hereafter as the mixing step). In this case the insulating liquid (a) is preferably added to the second solution or dispersion.

As indicated in the preceding, the binder resin is preferably caused to undergo precipitation (i.e., separation into two phases) in this mixing step. Due to this, the insulating liquid (a) is preferably admixed in an amount at which the binder resin undergoes separation to give two phases in the mixing step.

In the present invention, this "binder resin undergoes separation to give two phases" indicates a state in which the binder resin that had been present in a dissolved state in the second solution or dispersion, has undergone precipitation and the formation of binder resin particles can be identified.

A high shear force is preferably applied during the mixing of the insulating liquid (a) in the mixing step. This shear force should be set as appropriate in conformity to the desired particle diameter. A media-free disperser, e.g., a high-speed mixer, high-speed homogenizer, and so forth, is preferred for the high-speed shear device capable of applying a high shear force.

A variety of such devices exists with regard to capacity, rotation rate, configuration, and so forth, and a suitable device adapted to the production regime should be used. The rotation rate in the case of the use of a homogenizer is preferably at least 500 rpm and not more than 30,000 rpm and is more preferably at least 13,000 rpm and not more than 28,000 rpm.

The mixing step is preferably carried out at above the freezing points and below the boiling points of the solvent (b) and the insulating liquid (a). Specifically, it is preferably carried out at at least 0° C. and not more than 60° C.

The mixing mass ratio for the insulating liquid (a) and the solvent (b) [{mass of insulating liquid (a)}/{mass of insulating liquid (a)+mass of solvent (b)}] in the step (1) will vary with the combination of the insulating liquid (a), the solvent (b), and the binder resin composed of the polymer A and resin component other than the polymer A, but is preferably at least 0.2 and not more than 0.8 and is more preferably at least 0.3 and not more than 0.6.

When this mixing mass ratio is in the indicated range, a satisfactory concentration is established for the solids fraction after the distillative removal of the solvent (b), the toner particle dispersion stability is readily further enhanced, and the film thickness during development can be made thinner.

<Step (2)>

Step (2) is a step in which the solvent (b) is distillatively removed from the mixture obtained in the step (1).

Methods such as evaporation and so forth are suitable for the method for the distillative removal of the solvent (b). With regard to the conditions, distillative removal at a pressure of 1 to 200 kPa (reduced pressure condition) at 0 to 60° C. is preferred.

<Liquid Developer Preparation Step>

A liquid developer preparation step may be present in the present invention after the step (2). A liquid developer can be prepared in the liquid developer preparation step by the addition as necessary of, e.g., a charge control agent, other additives, and so forth, to the toner particle dispersion obtained in the step (2). There are no particular limitations on the method for adding the charge control agent and other additives, but a suitable heating and stirring may be carried out depending on the type of additive.

This step may also be supplemented as appropriate with unit processes such as, for example, toner particle washing.

<The Toner Particle>

A toner particle having a small particle diameter and a narrow particle size distribution can be produced by the production method of the present invention.

Viewed from the standpoint of obtaining a high-definition image, this toner particle has a volume-based 50% particle diameter (D50) of preferably at least 0.05 μm and not more than 5.0 μm, more preferably at least 0.05 μm and not more than 1.2 μm, and even more preferably at least 0.05 μm and not more than 1.0 μm.

When the volume-based 50% particle diameter (D50) of the toner particle is in the indicated range, a satisfactorily high resolution and image density can be provided for the toner image formed by the liquid developer and, in the case of a recording system in which the insulating liquid (a) remains on the recording medium, a satisfactorily thin film thickness can also be obtained for the toner image.

In this Specification, the "average particle diameter" denotes to the volume-based average particle diameter.

In addition, the toner particle size distribution is preferably at least 1.0 and not more than 5.0, more preferably at least 1.1 and not more than 4.0, and even more preferably at least 1.2 and not more than 3.0.

In the present invention the particle size distribution denotes the ratio (D95/D50) of the volume-based 95% particle diameter (D95) to the volume-based 50% particle diameter (D50).

When the toner particle size distribution is in the indicated range, the viscosity undergoes little change when the liquid developer concentration changes.

The toner particle concentration used in the liquid developer in the present invention can be freely adjusted in conformity to the image-forming apparatus used, but is desirably at least 1 mass % and not more than 70 mass %.

<Image-Forming Apparatus>

The liquid developer of the present invention can be advantageously used in common or ordinary image-forming apparatuses that utilize an electrophotographic system.

EXAMPLES

The present invention is described in detail in the following using examples, but the present invention is not limited to or by these examples. Unless specifically indicated otherwise, "parts" and "&" denotes "mass parts" and "mass %", respectively.

<Measurement Methods>

The measurement methods used in the examples are described below.

(1) Method for measuring the molecular weight [weight-average molecular weight (Mw) and number-average molecular weight (Mn)]

The molecular weight of, e.g., the resins and so forth, was determined as polystyrene using gel permeation chromatography (GPC). The measurement of the molecular weight by GPC was carried out as follows.

A solution was prepared by adding the sample to the eluent indicated below to provide a sample concentration of 1.0 mass % and dissolving by standing for 24 hours at room temperature. This solution was filtered across a solvent-resistant membrane filter with a pore diameter of 0.20 μm to obtain the sample solution, and measurement was performed under the following conditions.

instrument: "HLC-8220GPC" high-performance GPC instrument (from Tosoh Corporation)
column: 2×LF-804
eluent: tetrahydrofuran (THF)
flow rate: 1.0 mL/minute
oven temperature: 40° C.
sample injection amount: 0.025 mL The molecular weight calibration curve used to determine the molecular weight of the sample was constructed using polystyrene resin standards [TSK Standard Polystyrene F-850, F-450, F-288, F-128, F-80, F-40, F-20, F-10, F-4, F-2, F-1, A-5000, A-2500, A-1000, and A-500, from Tosoh Corporation].

(2) Method for Measuring the Acid Value

The acid value of the binder resin was determined using the following method.

The basic procedure is based on JIS K 0070.

1) Weigh exactly 0.5 to 2.0 g of the sample. This mass is designated M1 (g).

2) Place the sample in a 50-mL beaker and add 25 mL of a tetrahydrofuran/ethanol (2/1) mixture and dissolve.

3) Perform titration using an ethanol solution of 0.1 mol/L KOH and using a potentiometric titrator [for example, a "COM-2500" automatic titrator from Hiranuma Sangyo Co., Ltd. can be used].

4) The amount of the KOH solution used at this time is designated A (mL). The blank is measured at the same time, and the amount of KOH used for this is designated B (mL).

5) The acid value is calculated using the following formula (i). f is the factor for the KOH solution.

$$\text{acid value [mg KOH/g]} = \frac{[(A-B)\times f\times 5.61]}{M1} \quad \text{formula (i)}$$

(3) Method for Measuring the Hydroxyl Value

The hydroxyl value of the binder resin was determined using the following method.

The basic procedure is based on JIS K 0070-1992.

1) Introduce 25 g of special grade acetic anhydride into a 100-mL volumetric flask; bring the total to 100 mL by adding pyridine; and obtain the acetylation reagent by thorough shaking. Store the resulting acetylation reagent in a brown bottle avoiding contact with, e.g., humidity, carbon dioxide, and so forth.

2) Weigh exactly 0.5 to 2.0 g of the sample. This mass is designated M2 (g).

3) Place the sample in a 50-mL flask and add 25 mL of a tetrahydrofuran/ethanol (2/1) mixture and dissolve.

4) To this add exactly 5.0 mL of the acetylation reagent using a volumetric pipette. At this time, mount a small funnel in the mouth of the flask, and heat by immersing the bottom of the flask approximately 1 cm in a glycerin bath at approximately 97° C. At this point, heavy paper provided with a round hole is preferably mounted at the base of the neck of the flask in order to prevent the temperature of the neck of the flask from rising due to the effect of heat from the bath.

5) After 1 hour, remove the flask from the glycerin bath and allow to cool. After cooling, hydrolyze the acetic anhydride by adding 1 mL of water through the funnel and shaking. Reheat the flask for 10 minutes on the glycerin bath in order to achieve complete hydrolysis.

6) Perform titration using an ethanol solution of 0.1 mol/L KOH and using a potentiometric titrator [for example, a "COM-2500" automatic titrator from Hiranuma Sangyo Co., Ltd. can be used]. The titration value here is designated C (mL). Measure the blank at the same time and designate the amount of the KOH used for this as D (mL).

7) The obtained results are substituted into the following formula (ii) to calculate the hydroxyl value.

$$\text{hydroxyl value [mg KOH/g]} = \frac{[(D-C)\times 28.05\times f]}{M2} + \text{acid value [mg KOH/g]} \quad \text{formula (ii)}$$

(4) Method for Measuring the Phase Separation Point

The mixing mass ratio for the insulating liquid (a) and the solvent (b) at which the polymer or resin undergoes separation to give two phases (the phase separation point) was determined using the following method.

1) A solution of the solvent (b) containing 10 mass % of the sample is prepared.

2) Approximately 1.0 g of this solvent (b) solution is weighed into a 10-mL sample vial. The mass at this point is designated W [g].

3) While stirring this solvent (b) solution, the insulating liquid (a) is added dropwise. The mass of the added insulating liquid (a) at this point is designated X [g].

4) Using formula (iii) below, the mixing mass ratio for the insulating liquid (a) and the solvent (b) at which separation into two phases occurs (phase separation point) is calculated.

The occurrence of the separation of the polymer or resin to give two phases due to the dropwise addition of the insulating liquid (a) (i.e., the precipitation of the polymer or resin that had been present in a dissolved state in the solvent (b)) is visually determined as a turbid solution.

$$\text{phase separation point} = \frac{X}{0.9\times W + X} \quad \text{formula (iii)}$$

Polymer A Production Example

Production Example for Polyester Polyols (PES-1) to (PES-6)

Polyester polyols (PES-1) to (PES-6) with the compositions given in Table 1 were synthesized by a known method, and their properties are given in Table 1. The individual components in the table are indicated as molar ratios. In addition, PES-6 had a phase separation point of 0.21 when dodecyl vinyl ether was used for the insulating liquid (a) and tetrahydrofuran was used for the solvent (b); PES-6 had a phase separation point of 0.16 when Moresco White MT-30P was used for the insulating liquid (a) and tetrahydrofuran was used for the solvent (b).

TABLE 1

| polyester polyol | TPA | SIPA | NPG | PG | DPG | BPA-EO | Mn | Mw | acid value (mgKOH/g) | hydroxyl value (mgKOH/g) |
|---|---|---|---|---|---|---|---|---|---|---|
| PES-1 | 43 | 1 | 4 | 36 | 8 | — | 1400 | 2800 | 0.5 | 90.0 |
| PES-2 | 42 | 2 | 4 | 36 | 8 | — | 1490 | 3540 | 1.2 | 92.0 |
| PES-3 | 42 | 2 | 4 | 36 | 8 | — | 2470 | 6550 | 0.6 | 45.0 |
| PES-4 | 42 | 2 | 10 | 30 | 8 | — | 1560 | 3540 | 0.5 | 91.0 |
| PES-5 | 42 | 2 | — | — | — | 48 | 1420 | 3250 | 1.0 | 93.0 |
| PES-6 | 43 | 1 | 4 | 36 | 8 | — | 2170 | 15010 | 15.0 | 14.0 |

The abbreviations used in Table 1 are defined as follows.
TPA: terephthalic acid
SIPA: monosodium 5-sulfoisophthalate
NPG: neopentyl glycol
PG: propylene glycol
DPG: dipropylene glycol
BPA-EO: adduct of 2 moles ethylene oxide on bisphenol A Polymer A: Production Example for Urethane-Modified Polyester (UPES-1)

10 parts of diphenylmethane diisocyanate (MDI) was added to 100 parts of the polyester polyol (PES-1) dissolved in 300 parts tetrahydrofuran, and the urethane-modified polyester (UPES-1) was obtained by reacting for 5 hours at 90° C. The properties of the urethane-modified polyester (UPES-1) are given in Table 2.

Polymer A: Production Example for Urethane-Modified Polyesters (UPES-2) to (UPES-6)

Urethane-modified polyesters (UPES-2) to (UPES-6) were produced by the same method as in the Production Example for Urethane-Modified Polyester (UPES-1), but changing the polyester polyol (PES-1) and MDI in the Production Example for Urethane-Modified Polyester (UPES-1) to the polyester polyol and diisocyanate that corresponded to the target urethane-modified polyester. The properties of the urethane-modified polyesters (UPES-2) to (UPES-6) are given in Table 2.

The phase separation point 2 gives the phase separation point for the use of Moresco White MT-30P for the insulating liquid (a) and the use of tetrahydrofuran for the solvent (b).

Polymer A: Production Example for Polystyrene-Acrylic Acid-Sodium p-Styrenesulfonate Copolymer (PS-1)

100 parts of propylene glycol monomethyl ether was heated under reflux at a liquid temperature of at least 120° C. while carrying out nitrogen substitution, and to this was added dropwise over 3 hours a mixture of 158 parts of styrene, 40 parts of acrylic acid, 2 parts of sodium p-styrenesulfonate, and 1 part of tert-butyl peroxybenzoate [organoperoxide polymerization initiator, product name: PERBUTYL Z, NOF Corporation]. After the completion of the dropwise addition, the solution was stirred for 3 hours, followed by solvent removal by distillation at normal pressure while raising the solution temperature to 170° C. and, after the solution temperature had reached 170° C., distillation for 1 hour under a reduced pressure of 1 hPa, thus yielding the polystyrene-acrylic acid-sodium p-styrenesulfonate copolymer (PS-1).

PS-1 had an Mn of 6,000, an Mw of 11,020, an acid value of 40 mg KOH/g, a phase separation point of 0.35 for the use of dodecyl vinyl ether for the insulating liquid (a) and tetrahydrofuran for the solvent (b), and a phase separation point of 0.27 for the use of Moresco WHITE MT-30P for the insulating liquid (a) and tetrahydrofuran for the solvent (b).

TABLE 2

| urethane-modified polyester | polyester polyol | diisocyanate | Mn | Mw | acid value (mgKOH/g) | hydroxyl value (mgKOH/g) | phase separation point 1 | phase separation point 2 |
|---|---|---|---|---|---|---|---|---|
| UPES-1 | PES-1 | MDI | 20,500 | 50,700 | 0.9 | 3.5 | 0.25 | 0.19 |
| UPES-2 | PES-2 | MDI | 20,460 | 60,400 | 1.0 | 4.1 | 0.23 | 0.18 |
| UPES-3 | PES-2 | MDI | 10,830 | 36,900 | 0.9 | 5.8 | 0.26 | 0.20 |
| UPES-4 | PES-3 | MDI | 19,700 | 51,100 | 0.4 | 2.2 | 0.23 | 0.18 |
| UPES-5 | PES-4 | MDI | 21,130 | 54,600 | 0.5 | 2.0 | 0.24 | 0.18 |
| UPES-6 | PES-5 | MDI-H | 20,420 | 86,100 | 0.0 | 8.0 | 0.22 | 0.17 |

The abbreviations used in Table 2 are defined as follows.
MDI: diphenylmethane diisocyanate
MDI-H: dicyclohexylmethane 4,4'-diisocyanate The phase separation point 1 gives the phase separation point for the use of dodecyl vinyl ether for the insulating liquid (a) and the use of tetrahydrofuran for the solvent (b).

Production Example for Comparative Polyester Polyols (PES-001) and (PES-002)

Polyester polyols (PES-001) and (PES-002) with the compositions given in Table 3 were synthesized by a known method, and their properties are given in Table 3. The individual components in the table are given as molar ratios.

TABLE 3

| polyester polyol | TPA | SIPA-H | NPG | PG | DPG | Mn | Mw | acid value (mgKOH/g) | hydroxyl value (mgKOH/g) |
|---|---|---|---|---|---|---|---|---|---|
| PES-001 | 44 | — | 4 | 36 | 8 | 1400 | 2800 | 0.5 | 90 |
| PES-002 | 42 | 2 | 4 | 36 | 8 | 1380 | 3500 | could not be measured | could not be measured |

The abbreviations used in Table 3 are defined as follows.

TPA: terephthalic acid

SIPA-H: 5-sulfoisophthalic acid

NPG: neopentyl glycol

PG: propylene glycol

DPG: dipropylene glycol

Production Example for the Resin Component (Also Referred to Below as Polymer B) in the Binder Resin Other than Polymer A Production Example for Polyesters (PES-101) and (PES-102)

Polyesters with the compositions given in Table 5 were synthesized by a known method, and their properties are given in Table 5. The compositions in the table are indicated as molar ratios.

TABLE 5

| polyester | composition TPA/TMA/BPA-EO | Mw | Mn | acid value (mgKOH/g) | hydroxyl value (mgKOH/g) | phase separation point 1 | phase separation point 2 |
|---|---|---|---|---|---|---|---|
| PES-101 | 37.5/12.5/50 | 18300 | 2420 | 20.5 | 50.3 | 0.22 | 0.17 |
| PES-102 | 50/0/50 | 10200 | 3160 | 12.2 | 19.6 | 0.29 | 0.22 |

The acid value of PES-002 could not be measured due to the inability to differentiate the sulfonic acid in the neutralization titration.

Production Example for Comparative Urethane-Modified Polyester (UPES-001)

10 parts of diphenylmethane diisocyanate (MDI) was added to 100 parts of the polyester polyol (PES-001) dissolved in 300 parts of tetrahydrofuran, and the urethane-modified polyester (UPES-001) was obtained by reaction for 5 hours at 90° C. The properties of the urethane-modified polyester (UPES-001) are given in Table 4.

Production Example for Comparative Urethane-Modified Polyester (UPES-002)

10 parts of diphenylmethane diisocyanate (MDI) was added to 100 parts of the polyester polyol (PES-002) dissolved in 300 parts of tetrahydrofuran, and the urethane-modified polyester (UPES-002) was obtained by reaction for 5 hours at 90° C. The properties of the urethane-modified polyester (UPES-002) are given in Table 4.

TABLE 4

| urethane-modified polyester | polyester polyol | diisocyanate | Mn | Mw | acid value (mgKOH/g) | hydroxyl value (mgKOH/g) | phase separation point 1 | phase separation point 2 |
|---|---|---|---|---|---|---|---|---|
| UPES-001 | PES-001 | MDI | 23,000 | 70,000 | 0.6 | 3.1 | 0.29 | 0.22 |
| UPES-002 | PES-002 | MDI | 20,100 | 63,400 | could not be measured | could not be measured | 0.28 | 0.21 |

The acid value of UPES-002 in Table 4 could not be measured due to the inability to differentiate the sulfonic acid in the neutralization titration.

The phase separation point 1 gives the phase separation point for the use of dodecyl vinyl ether for the insulating liquid (a) and the use of tetrahydrofuran for the solvent (b).

The phase separation point 2 gives the phase separation point for the use of Moresco White MT-30P for the insulating liquid (a) and the use of tetrahydrofuran for the solvent (b).

The abbreviations used in Table 5 are defined as follows.

TPA: terephthalic acid

TMA: trimellitic acid

BPA-EO: adduct of 2 moles ethylene oxide on bisphenol A

The phase separation point 1 gives the phase separation point for the use of dodecyl vinyl ether for the insulating liquid (a) and the use of tetrahydrofuran for the solvent (b).

The phase separation point 2 gives the phase separation point for the use of Moresco White MT-30P for the insulating liquid (a) and the use of tetrahydrofuran for the solvent (b).

Liquid Developer Production Example

Production Example for Colorant Dispersion (Cy-1)

30 parts of Pigment Blue 15:3, 15 parts of a 32% tetrahydrofuran solution of the urethane-modified polyester (UPES-1), 15 parts of AJISPER PB-821 (Ajinomoto Fine-Techno Co., Inc.), 255 parts of tetrahydrofuran, and 130 parts of glass beads (1 mm diameter) were mixed and were dispersed for 3 hours using an attritor (Nippon Coke & Engineering Co., Ltd.) followed by filtration across a mesh to obtain a kneaded material.

18 parts of the resulting kneaded material, 12.6 parts of a 50% tetrahydrofuran solution of the polyester (PES-101), and 2.1 parts of a dispersing agent (AJISPER PB-817, Ajinomoto Fine-Techno Co., Inc.) were mixed using a high-speed disperser (T.K. Robomix/T.K. Homodisper Model 2.5 blade, Primix Corporation) and mixing was carried out while stirring at 40° C. to obtain a colorant dispersion (Cy-1).

Production Example for Colorant Dispersions (Cy-2) to (Cy-8)

The colorant dispersions (Cy-2) to (Cy-8) were obtained using the same method as in the Production Example for Colorant Dispersion (Cy-1), but changing the urethane-modified polyester (UPES-1) used in the Production Example for Colorant Dispersion (Cy-1) to the urethane-modified polyesters (UPES-2) to (UPES-6), the polyester polyol (PES-6), and the polystyrene-acrylic acid-sodium p-styrenesulfonate copolymer (PS-1), respectively.

Production Example for Colorant Dispersion (Cy-9)

The colorant dispersion (Cy-9) was obtained using the same method as in the Production Example for Colorant Dispersion (Cy-1), but changing the 12.6 parts of the 50% tetrahydrofuran solution of the polyester (PES-101) used in the Production Example for Colorant Dispersion (Cy-1) to 12.6 parts of a 50% tetrahydrofuran solution of the polyester (PES-102).

Production Example for Colorant Dispersion (Cy-10)

The colorant dispersion (Cy-10) was obtained using the same method as in the Production Example for Colorant Dispersion (Cy-1), but changing the 2.1 parts of the dispersing agent (AJISPER PB-817, Ajinomoto Fine-Techno Co., Inc.) used in the Production Example for Colorant Dispersion (Cy-1) to 5.3 parts of the dispersing agent SOLSPERSE 13940 (dispersing agent concentration=40%, Lubrizol Japan Ltd.).

Production Example for Colorant Dispersions (M-1), (Y-1), and (Bk-1)

Colorant dispersions (M-1), (Y-1), and (Bk-1) were produced by the same method as in the Production Example for Colorant Dispersion (Cy-1), but changing the Pigment Blue 15:3 used in the Production Example for Colorant Dispersion (Cy-1) to Pigment Red 122, Pigment Yellow 155, and carbon black, respectively.

Production Example for Toner Particle Dispersion (T-1)

<Mixing Step>

While carrying out high-speed stirring (rotation rate=25,000 rpm) using a homogenizer (Ultra-Turrax T50, IKA® Japan K.K.), 200 parts of Moresco WHITE MT-30P (Matsumura Oil Co., Ltd.) was added in small portions to 100 parts of the colorant dispersion (Cy-1) obtained as described above to prepare a mixture.

<Distillative Removal Step>

The mixture obtained as described above was transferred to a recovery flask and the tetrahydrofuran was completely distilled out at 50° C. while carrying out ultrasound dispersion, to obtain a toner particle dispersion (T-1) in which toner particles were dispersed in an insulating liquid.

Production Example for Toner Particle Dispersions (T-2) to (T-13)

Toner particle dispersions (T-2) to (T-13) were obtained by the same method as in the Production Example for Toner Particle Dispersion (T-1), but respectively changing the colorant dispersion (Cy-1) used in the Production Example for Toner Particle Dispersion (T-1) as shown in Table 6.

Production Example for Toner Particle Dispersion (T-101)

Toner particle dispersion (T-101) was obtained by the same method as in the Production Example for Toner Particle Dispersion (T-1), but changing the 200 parts of Moresco WHITE MT-30P used in the Production Example for Toner Particle Dispersion (T-1) to 200 parts of dodecyl vinyl ether (DDVE).

Production Example for Toner Particle Dispersions (T-102) to (T-113)

Toner particle dispersions (T-102) to (T-113) were obtained by the same method as in the Production Example for Toner Particle Dispersion (T-101), but respectively changing the colorant dispersion (Cy-1) used in the Production Example for Toner Particle Dispersion (T-101) as shown in Table 6.

Liquid Developer Preparation Step

Production Example for Liquid Developers (LD-1) to (LD-13)

For each of the obtained toner particle dispersions (T-1) to (T-13), 10 parts was subjected to a centrifugal separation process and the supernatant was removed by decantation. After this, fresh Moresco White MT-30P was added in a mass equal to that of the removed supernatant and the particular toner particle dispersion was redispersed. 0.10 parts of Lecinol S-10 (hydrogenated lecithin, Nikko Chemicals Co., Ltd.) was added to each of the obtained dispersions to obtain liquid developers (LD-1) to (LD-13).

Production Example for Liquid Developers (LD-101) to (LD-113)

Liquid developers (LD-101) to (LD-113) were obtained by the same method as in the Production Example for Liquid Developers (LD-1) to (LD-13), but changing the toner particle dispersions (T-1) to (T-13) used in the Production Example for Liquid Developers (LD-1) to (LD-13) to toner particle dispersions (T-101) to (T-113) and changing the Moresco WHITE MT-30P to dodecyl vinyl ether (DDVE).

TABLE 6

| liquid developer | toner particle dispersion | colorant dispersion | polymer A | polymer B | dispersing agent | insulating liquid (a) | solvent (b) |
|---|---|---|---|---|---|---|---|
| LD-1 | T-1 | Cy-1 | UPES-1 | PES-101 | PB-817 | MT30P | THF |
| LD-2 | T-2 | Cy-2 | UPES-2 | PES-101 | PB-817 | MT30P | THF |
| LD-3 | T-3 | Cy-3 | UPES-3 | PES-101 | PB-817 | MT30P | THF |
| LD-4 | T-4 | Cy-4 | UPES-4 | PES-101 | PB-817 | MT30P | THF |

TABLE 6-continued

| liquid developer | toner particle dispersion | colorant dispersion | polymer A | polymer B | dispersing agent | insulating liquid (a) | solvent (b) |
|---|---|---|---|---|---|---|---|
| LD-5 | T-5 | Cy-5 | UPES-5 | PES-101 | PB-817 | MT30P | THF |
| LD-6 | T-6 | Cy-6 | UPES-6 | PES-101 | PB-817 | MT30P | THF |
| LD-7 | T-7 | Cy-7 | PES-6 | PES-101 | PB-817 | MT30P | THF |
| LD-8 | T-8 | Cy-8 | PS-1 | PES-101 | PB-817 | MT30P | THF |
| LD-9 | T-9 | Cy-9 | UPES-1 | PES-102 | PB-817 | MT30P | THF |
| LD-10 | T-10 | Cy-10 | UPES-1 | PES-101 | S13940 | MT30P | THF |
| LD-11 | T-11 | M-1 | UPES-1 | PES-101 | PB-817 | MT30P | THF |
| LD-12 | T-12 | Y-1 | UPES-1 | PES-101 | PB-817 | MT30P | THF |
| LD-13 | T-13 | Bk-1 | UPES-1 | PES-101 | PB-817 | MT30P | THF |
| LD-101 | T-101 | Cy-1 | UPES-1 | PES-101 | PB-817 | DDVE | THF |
| LD-102 | T-102 | Cy-2 | UPES-2 | PES-101 | PB-817 | DDVE | THF |
| LD-103 | T-103 | Cy-3 | UPES-3 | PES-101 | PB-817 | DDVE | THF |
| LD-104 | T-104 | Cy-4 | UPES-4 | PES-101 | PB-817 | DDVE | THF |
| LD-105 | T-105 | Cy-5 | UPES-5 | PES-101 | PB-817 | DDVE | THF |
| LD-106 | T-106 | Cy-6 | UPES-6 | PES-101 | PB-817 | DDVE | THF |
| LD-107 | T-107 | Cy-7 | PES-6 | PES-101 | PB-817 | DDVE | THF |
| LD-108 | T-108 | Cy-8 | PS-1 | PES-101 | PB-817 | DDVE | THF |
| LD-109 | T-109 | Cy-9 | UPES-1 | PES-102 | PB-817 | DDVE | THF |
| LD-110 | T-110 | Cy-10 | UPES-1 | PES-101 | S13940 | DDVE | THF |
| LD-111 | T-111 | M-1 | UPES-1 | PES-101 | PB-817 | DDVE | THF |
| LD-112 | T-112 | Y-1 | UPES-1 | PES-101 | PB-817 | DDVE | THF |
| LD-113 | T-113 | Bk-1 | UPES-1 | PES-101 | PB-817 | DDVE | THF |

In Table 6, the PB-817 denotes Ajisper PB-817 and the S13940 denotes Solsperse 13940.

Production Example for Comparative Liquid Developers

Production Example for Comparative Colorant Dispersion (Cy-001)

A comparative colorant dispersion (Cy-001) was obtained by the same method as in the Production Example for Colorant Dispersion (Cy-1), except that the urethane-modified polyester (UPES-1) used in the Production Example for Colorant Dispersion (Cy-1) was not added.

Production Example for Comparative Colorant Dispersions (Cy-002) and (Cy-003)

Comparative colorant dispersions (Cy-002) and (Cy-003) were obtained by the same method as in the Production Example for Colorant Dispersion (Cy-1), but changing the urethane-modified polyester (UPES-1) used in the Production Example for Colorant Dispersion (Cy-1) to the comparative urethane-modified polyester (UPES-001) or (UPES-002).

Production Example for Comparative Toner Particle Dispersions (T-001) to (T-003)

Comparative toner particle dispersions (T-001) to (T-003) were obtained by the same method as in the Production Example for Toner Particle Dispersion (T-1), but changing the colorant dispersion (Cy-1) used in the Production Example for Toner Particle Dispersion (T-1) to comparative colorant dispersions (Cy-001) to (Cy-003).

Production Example for Comparative Toner Particle Dispersions (T-004) to (T-006)

Comparative toner particle dispersions (T-004) to (T-006) were obtained by the same method as in the Production Example for Comparative Toner Particle Dispersions (T-001) to (T-003), but changing the 200 parts of Moresco WHITE MT-30P used in the Production Example for Comparative Toner Particle Dispersions (T-001) to (T-003) to 200 parts of dodecyl vinyl ether (DDVE).

Production Example for Comparative Liquid Developers (LD-001) to (LD-003)

Comparative liquid developers (LD-001) to (LD-003) were obtained by the same method as in the Production Example for liquid Developer (LD-1), but using comparative toner particle dispersions (T-001) to (T-003) for the toner particle dispersion (T-1) used in the Production Example for Liquid Developer (LD-1).

Production Example for Comparative Liquid Developers (LD-004) to (LD-006)

Comparative liquid developers (LD-004) to (LD-006) were obtained by the same method as in the Production Example for Liquid Developer (LD-101), but using comparative toner particle dispersions (T-004) to (T-006) for the toner particle dispersion (T-101) used in the Production Example for Liquid Developer (LD-101).

The compositions of comparative liquid developers (LD-001) to (LD-006) are given in Table 7.

TABLE 7

| liquid developer | toner particle dispersion | colorant dispersion | polymer A | polymer B | dispersing agent | insulating liquid (a) | solvent (b) |
|---|---|---|---|---|---|---|---|
| LD-001 | T-001 | Cy-001 | — | PES-101 | PB-817 | MT30P | THF |
| LD-002 | T-002 | Cy-002 | UPES-001 | PES-101 | PB-817 | MT30P | THF |
| LD-003 | T-003 | Cy-003 | UPES-002 | PES-101 | PB-817 | MT30P | THF |
| LD-004 | T-004 | Cy-001 | — | PES-101 | PB-817 | DDVE | THF |

TABLE 7-continued

| liquid developer | toner particle dispersion | colorant dispersion | polymer A | polymer B | dispersing agent | insulating liquid (a) | solvent (b) |
|---|---|---|---|---|---|---|---|
| LD-005 | T-005 | Cy-002 | UPES-001 | PES-101 | PB-817 | DDVE | THF |
| LD-006 | T-006 | Cy-003 | UPES-002 | PES-101 | PB-817 | DDVE | THF |

The PB-817 in Table 7 denotes Ajisper PB-817.

Examples 1 to 26

Liquid developers (LD-1) to (LD-13) and (LD-101) to (LD-113) were evaluated using the following methods.

<Measurement and Evaluation of the Toner Particle Diameter>

The volume-based 50% particle diameter (D50) (μm) of the toner particles in the liquid developers was measured using a laser diffraction/scattering particle size distribution analyzer (product name: "LA-950", Horiba, Ltd.). The evaluation criteria are given below. 3 and above was regarded as good in this evaluation.

5: (D50)≤1.0

4: 1.0<(D50)≤1.2

3: 1.2<(D50)≤1.5

2: 1.5<(D50)≤2.0

1: 2.0<(D50)

<Measurement and Evaluation of the Toner Particle Size Distribution>

The volume-based 50% particle diameter (D50) and the volume-based 95% particle diameter (D95) of the toner particles in the liquid developers were measured using a laser diffraction/scattering particle size distribution analyzer (product name: "LA-950", Horiba, Ltd.). The ratio (D95/D50) between the volume-based 50% particle diameter (D50) and the volume-based 95% particle diameter (D95) was used to evaluate the particle size distribution.

The evaluation criteria for the particle size distribution are given below. 3 and above was regarded as good in this evaluation.

5: (D95/D50)≤2

4: 2<(D95/D50)≤3

3: 3<(D95/D50)≤5

2: 5<(D95/D50)≤10

1: 10<(D95/D50)

<Evaluation of the Developing Performance>

Development was carried out by the following method using the liquid developers described above. A developing assembly 50C as described in FIG. 1 was used for the apparatus.

(1) A developing roller 53C, a photosensitive drum 52C, and an intermediate transfer roller 61C were separated from each other and these were rotationally driven in a noncontact condition in the direction of the arrows in FIG. 1. The rotation rate here was 250 mm/sec.

(2) The developing roller 53C and the photosensitive drum 52C were brought into contact at a prescribed pressing pressure and the developing bias was set to 200 V using a DC power source.

(3) The photosensitive drum 52C and the intermediate transfer roller 61C were brought into contact at a prescribed pressing pressure and a transfer bias of 1000 V was established using a DC power source.

(4) The liquid developer at a uniform concentration (toner particle concentration=2 mass %) and a uniform amount (100 mL) was supplied onto a film-forming roller (not shown), and the image formed on the intermediate transfer member 60C was evaluated.

The evaluation criteria for the developing performance are given below. 3 and above was regarded as good in this evaluation.

5: a high-density, high-definition image was obtained

4: some image density non-uniformity is present, or some image blurring is seen

3: image density non-uniformity and/or image blurring is conspicuous, but development is still recognized 2: severe image density non-uniformity and/or image blurring was produced and development was unsatisfactory 1: development could not be carried out The results of the evaluations are given in Table 8.

Comparative Examples 1 to 6

Evaluations were carried out on the comparative liquid developers (LD-001) to (LD-006) using the same methods as in Examples 1 to 26. The results of the evaluations are given in Table 8.

TABLE 8

| | liquid developer | particle diameter | particle size distribution | developing performance | | liquid developer | particle diameter | particle size distribution | developing performance |
|---|---|---|---|---|---|---|---|---|---|
| Example 1 | LD-1 | 5 | 5 | 5 | Example 14 | LD-101 | 5 | 5 | 5 |
| Example 2 | LD-2 | 5 | 5 | 5 | Example 15 | LD-102 | 5 | 5 | 5 |
| Example 3 | LD-3 | 4 | 4 | 3 | Example 16 | LD-103 | 4 | 4 | 3 |
| Example 4 | LD-4 | 5 | 5 | 5 | Example 17 | LD-104 | 5 | 5 | 5 |
| Example 5 | LD-5 | 5 | 5 | 5 | Example 18 | LD-105 | 5 | 5 | 5 |
| Example 6 | LD-6 | 3 | 3 | 3 | Example 19 | LD-106 | 3 | 3 | 3 |
| Example 7 | LD-7 | 5 | 3 | 3 | Example 20 | LD-107 | 5 | 3 | 3 |
| Example 8 | LD-8 | 4 | 3 | 3 | Example 21 | LD-108 | 4 | 3 | 3 |
| Example 9 | LD-9 | 5 | 4 | 3 | Example 22 | LD-109 | 5 | 4 | 3 |
| Example 10 | LD-10 | 5 | 3 | 4 | Example 23 | LD-110 | 5 | 3 | 4 |
| Example 11 | LD-11 | 5 | 5 | 5 | Example 24 | LD-111 | 5 | 5 | 5 |
| Example 12 | LD-12 | 5 | 5 | 5 | Example 25 | LD-112 | 5 | 5 | 5 |
| Example 13 | LD-13 | 5 | 5 | 5 | Example 26 | LD-113 | 5 | 5 | 5 |
| Comparative Example 1 | LD-001 | 1 | 3 | 2 | Comparative Example 4 | LD-004 | 1 | 3 | 2 |

TABLE 8-continued

| | liquid developer | particle diameter | particle size distribution | developing performance | | liquid developer | particle diameter | particle size distribution | developing performance |
|---|---|---|---|---|---|---|---|---|---|
| Comparative Example 2 | LD-002 | 1 | 2 | 1 | Comparative Example 5 | LD-005 | 1 | 2 | 1 |
| Comparative Example 3 | LD-003 | 1 | 2 | 1 | Comparative Example 6 | LD-006 | 1 | 2 | 1 |

As is clear from Table 8, the liquid developers produced by the method of the present invention have a small particle diameter and a narrow particle size distribution for the toner particles in the liquid developer and provide a good developing performance.

The use of the method of the present invention for producing a liquid composition can provide a liquid developer that has a small particle diameter for the toner particles in the liquid developer, that has a narrow toner particle size distribution, and that exhibits an excellent developing performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107350, filed May 27, 2015, Japanese Patent Application No. 2016-043105, filed Mar. 7, 2016, which are hereby incorporated by reference herein in their entirety.

What is claimed is:

1. A method of producing a liquid developer containing a dispersing agent, an insulating liquid (a), and a toner particle that contains a colorant and a binder resin, the method comprising:

a step (1) of preparing a mixture containing the colorant, the binder resin, the insulating liquid (a), a solvent (b), and the dispersing agent; and a step (2) of distillatively removing the solvent (b) from the mixture, wherein the binder resin dissolves in the solvent (b) and does not dissolve in the insulating liquid (a), the dispersing agent dissolves in both the insulating liquid (a) and the solvent (b), the binder resin contains a polymer A that has an alkali metal sulfonate group or an alkaline-earth metal sulfonate group, and the polymer A contains a polyester structure.

2. The method of producing a liquid developer according to claim 1, wherein the step (1) includes:

a step of preparing a solution or a dispersion by dissolving or dispersing the colorant, the binder resin, and the dispersing agent in the solvent (b); and a step of mixing the solution or dispersion with the insulating liquid (a) in order to precipitate the binder resin that had been present in a dissolved state in the solution or dispersion.

3. The method of producing a liquid developer according to claim 1, wherein the polymer A is obtained by the reaction of a diisocyanate compound with a polyester polyol that has an alkali metal sulfonate group or an alkaline-earth metal sulfonate group.

4. The method of producing a liquid developer according to claim 1, wherein the number-average molecular weight of the polymer A is 10,000 to 30,000.

5. The method of producing a liquid developer according to claim 1, wherein a phase separation point A is larger than a phase separation point B, where the phase separation point A is a mixing mass ratio for the insulating liquid (a) and the solvent (b) at which separation into two phases occurs when the insulating liquid (a) is added to a solution obtained by dissolving the polymer A in the solvent (b), the phrase separation point B is a mixing mass ratio for the insulating liquid (a) and the solvent (b) at which separation into two phases occurs when the insulating liquid (a) is added to a solution obtained by the dissolution in the solvent (b) of the resin component present in the binder resin other than the polymer A, and the mixing mass ratio for the insulating liquid (a) and the solvent (b) is a ratio determined by {mass of insulating liquid (a)}/{mass of insulating liquid (a)+mass of solvent (b)}.

6. The method of producing a liquid developer according to claim 1, wherein the acid value of the binder resin is at least 5 mg KOH/g, the dispersing agent is a polymer that contains at least both a monomer unit given by formula (1) and a monomer unit given by formula (2), and the dispersing agent has a monomer unit given by formula (1) at a position other than the terminal position, $$\text{-(K)-} \qquad \text{formula (1)}$$

where K is a monomer unit that has a primary amino group, $$\text{-(Q)-} \qquad \text{formula (2)}$$

where Q is a monomer unit having an optionally substituted alkyl group having at least 6 carbons, an optionally substituted cycloalkyl group having at least 6 carbons, an optionally substituted alkylene group having at least 6 carbons, or an optionally substituted cycloalkylene group having at least 6 carbons.

7. A method of producing a liquid developer containing a dispersing agent, an insulating liquid (a), and a toner particle that contains a colorant and a binder resin, the method comprising:

a step (1) of preparing a mixture containing the colorant, the binder resin, the insulating liquid (a), a solvent (b), and the dispersing agent; and a step (2) of distillatively removing the solvent (b) from the mixture, wherein the binder resin dissolves in the solvent (b) and does not dissolve in the insulating liquid (a), the dispersing agent dissolves in both the insulating liquid (a) and the solvent (b), and the binder resin contains a polymer A that has an alkali metal sulfonate group or an alkaline-earth metal sulfonate group, and a phase separation point A is larger than a phase separation point B, where the phase separation point A is a mixing mass ratio for the insulating liquid (a) and the solvent (b) at which separation into two phases occurs when the insulating liquid (a) is added to a solution obtained by dissolving the polymer A in the solvent (b), the phrase separation point B is a mixing mass ratio for the insulating liquid (a) and the solvent (b) at which separation into two phases occurs when the insulating liquid (a) is added to a solution obtained by the dissolution in the solvent (b) of the resin component present in the binder resin other than the polymer A, and the mixing mass ratio for the insulating liquid (a) and the solvent (b) is a ratio determined by {mass of insulating liquid (a)}/{mass of insulating liquid (a)+mass of solvent (b)}.

* * * * *